United States Patent [19]

Grüber et al.

[11] 4,183,234

[45] Jan. 15, 1980

[54] HORIZONTAL APPLICATOR

[75] Inventors: Heinz Grüber, Tönisvorst, Fed. Rep. of Germany; Alfred Keller, Inman, S.C.

[73] Assignee: Kusters Corporation, Spartanburg, S.C.

[21] Appl. No.: 881,119

[22] Filed: Feb. 24, 1978

[51] Int. Cl.[2] ..... D06B 1/06

[52] U.S. Cl. ..... 68/205 R; 118/325

[58] Field of Search ..... 68/205 R, 200, 202, 68/203; 118/324, 325

[56] References Cited

U.S. PATENT DOCUMENTS

| | | | |
|---|---|---|---|
| 430,256 | 6/1890 | Scott | 118/325 |
| 600,191 | 3/1898 | Buell | 68/202 |
| 2,188,442 | 1/1940 | Mills et al. | 68/202 X |
| 3,683,648 | 8/1972 | Fleissner | 68/205 R X |
| 3,718,427 | 2/1973 | Ahrweiler | 68/205 R X |
| 3,964,860 | 6/1976 | Leifeld | 68/205 R X |
| 4,033,153 | 7/1977 | Ahrweiler et al. | 68/205 R |

FOREIGN PATENT DOCUMENTS

| | | | |
|---|---|---|---|
| 2012828 | 10/1971 | Fed. Rep. of Germany | 68/205 R |

*Primary Examiner*—Philip R. Coe
*Attorney, Agent, or Firm*—Kenyon & Kenyon

[57] ABSTRACT

In apparatus for applying application liquid to a web of material moving therebelow, the apparatus including a pan, an application roll supported for rotation in said pan and a doctor blade which can be brought into contact with the edge of said roll to scrape liquid therefrom, the doctor blade being directed so that the liquid will flow in a film onto the web of material therebelow, the apparatus is made self supporting to permit it to be disposed directly above and closely adjacent to the web by a construction which includes: first and second side plates spaced apart with the roll extending between the side plates and supported in suitable bearings; a cross beam attached to said two side plates extending therebetween directly behind the roll, the pan being disposed between the plates and having a portion extending below the roll, with a plurality of rods attached to the inside of the bottom of the pan and supported by the cross beam; and a pan stiffener which is an integral portion of said pan secured to the two sides to provide support at the rear end of the pan.

14 Claims, 7 Drawing Figures

Fig. 3.
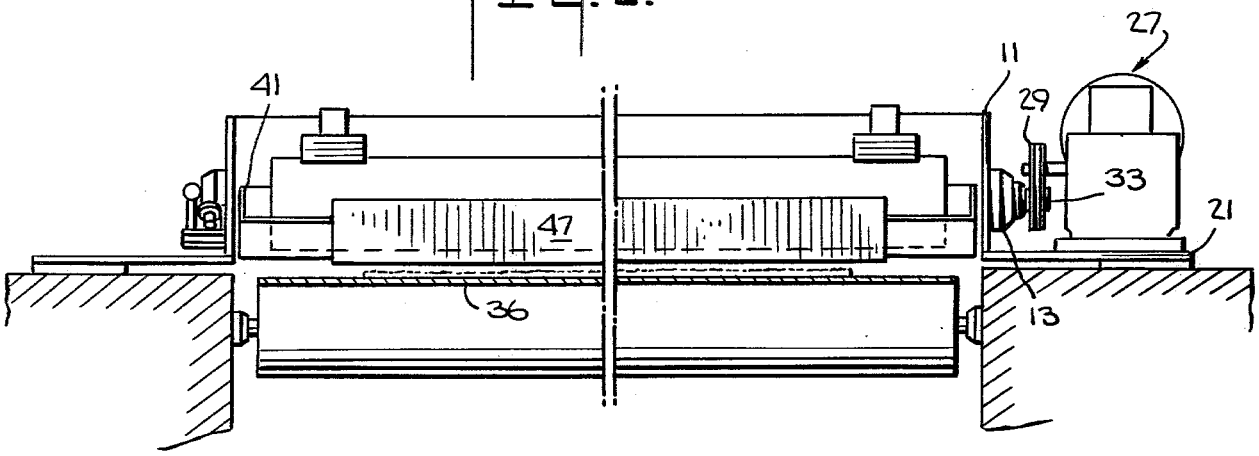
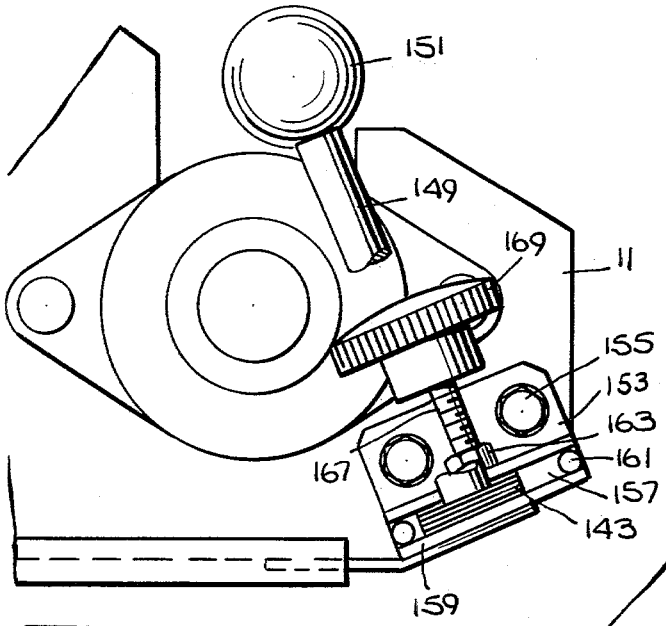
Fig. 5.
Fig. 7.
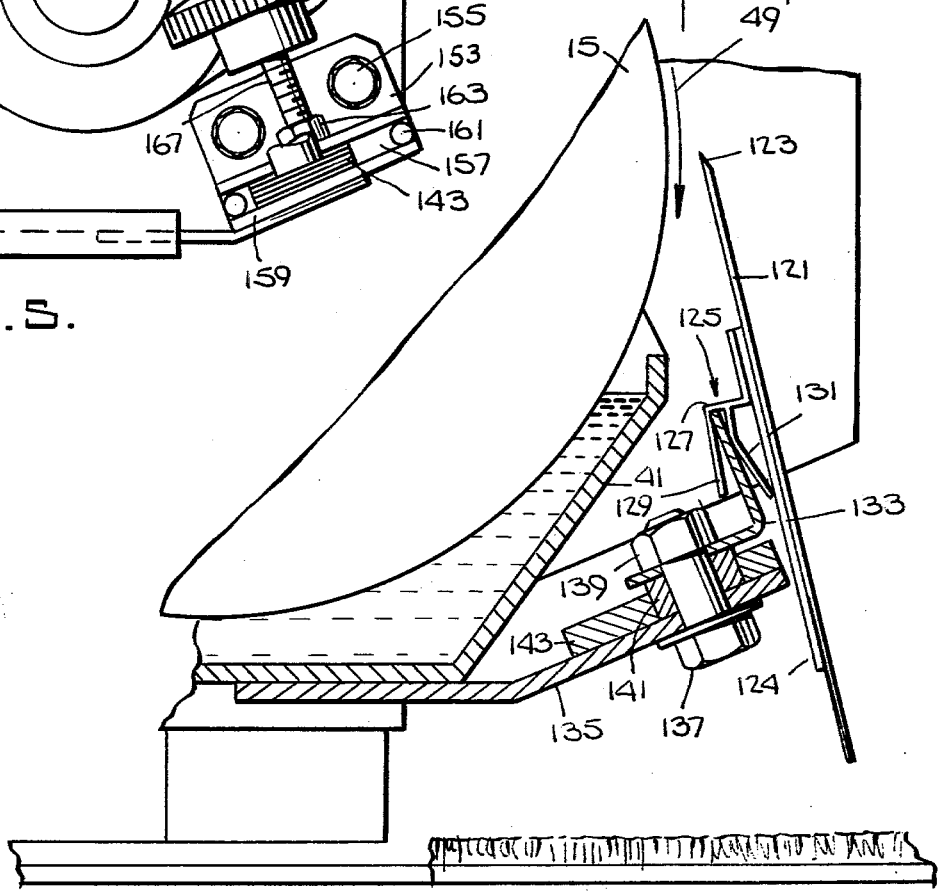

11
15
19
41
42
43
45
47
49
53
55
59
61
63
67
69
71
73
74
75
77
79
81
83
85
87
89
91
93
95
97
99
101
103
105
107
109
111
113
115
117
119
123
124

HORIZONTAL APPLICATOR

BACKGROUND OF THE INVENTION

This invention relates to apparatus for dyeing web carpets and the like in general and more particularly to an apparatus in which dye is applied to the carpet by means of a roll rotating in a trough with the dye liquid scraped therefrom by a doctor blade and in which the web passes horizontally beneath the trough in close proximity thereto.

Devices for the application of dye or the like to a web of material such as a carpet which utilize a roll rotating in a trough to pick up liquid which is scraped off by a doctor blade and then allowed to flow down the blade and drop onto the web of material are known. In such devices the trough, roller and doctor blade are all disposed above the web of material to be treated. Apparatus of this general type is disclosed in U.S. Pat. Nos. 3,964,860 and 4,033,153. Although, in the presentation in these patents, the web is shown as passing beneath the trough horizontally, in actual practice such is not usually the case. In actual practice, the carpet or other web normally approaches the applicator apparatus from below travelling in a generally vertical direction and is deflected to the horizontal right before passing beneath the doctor blade from which the dye liquid flows. The primary reasons for this arrangement is to permit adequate support of the roll and trough. It must be kept in mind that the trough extends across the full width of the carpet which can be as much as 15 feet. Furthermore, it extends rearward for a distance and contains a relatively large amount of liquid. Because of this, it requires good support, particularly when one considers the types of forces which will be applied to the trough because of the roll rotation.

It should also be noted that, in the aforementioned U.S. Pat. No. 3,964,860, which shows a plurality of applicators beneath which a basically horizontal web runs, there are other means between the doctor blade and carpet so that the troughs are raised up. This allows additional room for supporting structures.

However, there are also applications where it is desired to maintain the web horizontal at all times and where, with a short doctor blade, it is desired to have the doctor blade in close proximity to the web. It will be evident to those skilled in the art that having the doctor blade a long distance from the web, or even having a relatively long doctor blade, can result in uneven flow. What is desired is that the film of liquid from the doctor blade be spread evenly on the web. This requires that the doctor blade be relatively short and that it be relatively close to the web to avoid the formation of streams of liquid rather than a film of liquid.

In situations where the web must be horizontal and where these other conditions, i.e., a relatively narrow doctor blade and close proximity of the edge of the doctor blade to the web are required, the previously used supporting structure which was disposed vertically below the trough cannot be used. Thus, a need arises for applicating apparatus, in which a wide trough containing a roll from which liquid is scraped by a relatively narrow doctor blade and deposited on a carpet running horizontally therebelow, which is adequately supported without the need for large vertical supporting structures.

SUMMARY OF THE INVENTION

The present invention provides such liquid applicating apparatus. The apparatus includes two side plates of relatively small height. At one end of each of the side plates are disposed suitable bearings for a roll with the roll disposed therebetween. Directly behind the roll a cross beam is provided by means of which the two sides are bolted together. Because it is at this location, it can take up the forces generated at the rotating roller. A trough or pan for containing the liquid to be supplied is disposed between the two side plates and has a portion which extends beneath the roller. The rear portion of the pan contains a pan stiffener which extends beyond the edges of the pan to the two sides and acts as a rear support. The bottom of the pan is supported by a plurality of spaced rods welded thereto and bolted at the other end to the cross beam.

A bracket is provided at the front of the pan for supporting the doctor blade. The doctor blade can be engaged and disengaged from contact with the roll by means of a cam plate which executes a lateral motion to alternately move the doctor blade away from and bring it into contact with the roller.

Also provided is a wave breaker between the rear portion of the pan and the front portion where the liquid comes in contact with the roller.

The present invention provides a self-supporting applicator suitable for dyeing webs such as carpets or the like which is capable of holding sufficient liquid such as dye liquid but at the same time has a relatively small height and corresponding small doctor blade, thus allowing it to be disposed only a small distance above a horizontally moving web.

BRIEF DESCRIPTION OF THE DRAWINGS

FIG. 3 is a front view of the apparatus of FIG. 1.

FIG. 5 is a side view illustrating means for moving and securing the cam bar.

FIG. 7 is a cross-section through the view of FIG. 6.

DETAILED DESCRIPTION OF THE INVENTION

Figure 1:
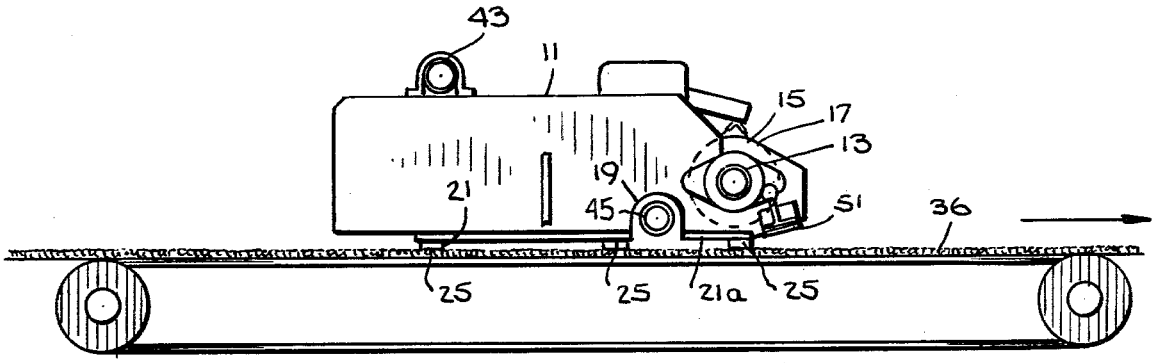
FIG. 1 is a side view of the horizontal applicator apparatus of the present invention.

FIG. 1 is a side view of the apparatus of the present invention. The apparatus includes two side plates 11 one of which is visible in the view of FIG. 1. Supported on each of the side plates is a bearing block 13 in which the shaft of a rotating roll 15 is disposed. The side plates 11 contain a suitable cutout 17 to permit the shaft of the roll 15 to pass therethrough. Another cutout 19 is formed for a drain pipe from a pan located within the confines of the side plates. Each of the sides 11 has a horizontal portion 21 used for support purposes.

Figure 2:
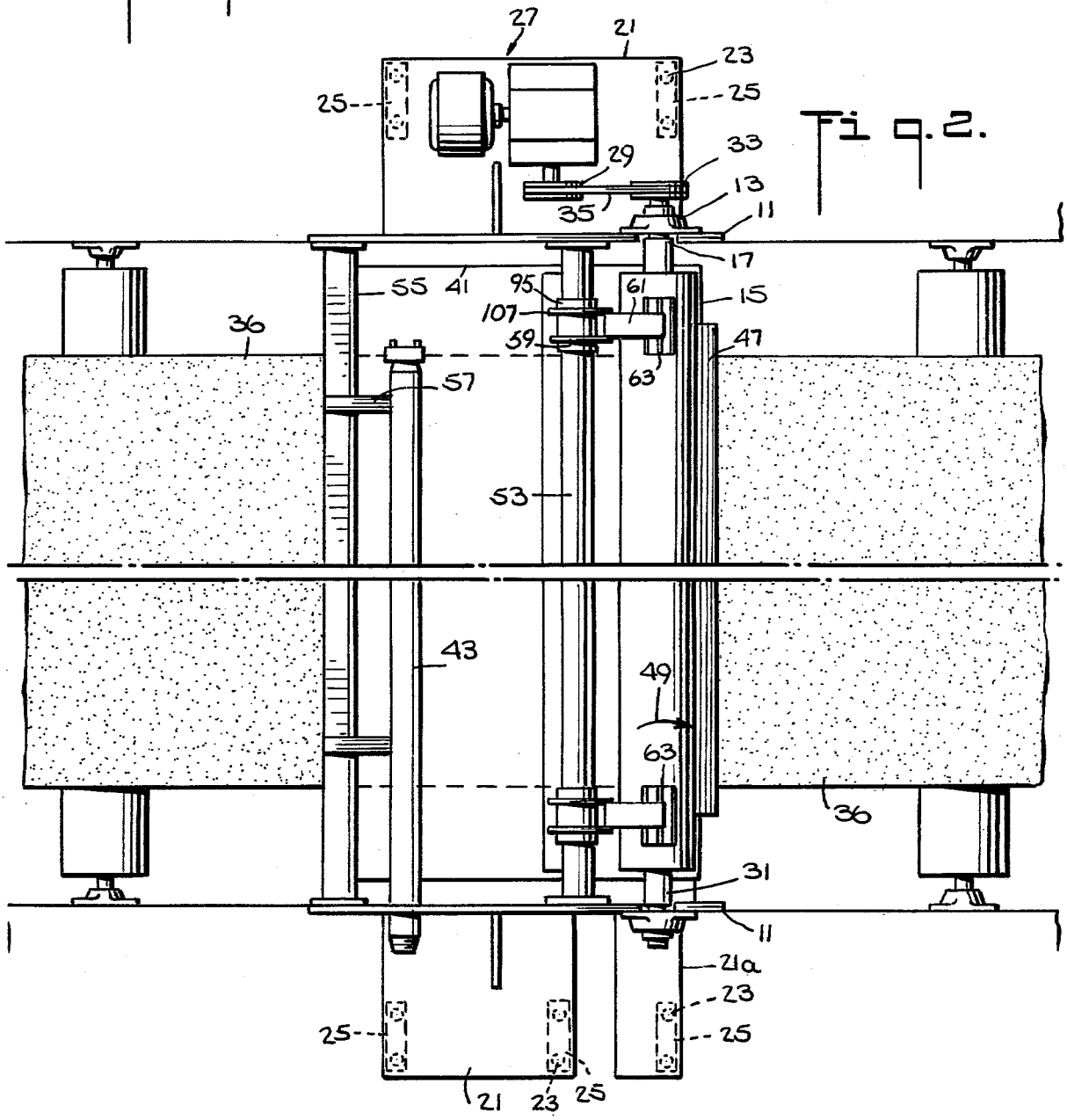
FIG. 2 is a plan view of the apparatus of FIG. 1.

This portion 21 can be better seen in the plan view of FIG. 2 and front view of FIG. 3. The members 21 contain suitable openings 23, e.g., holes or slots, for mounting purposes. Beneath the openings 23 are pads 25. Although, one member 21 on each side is sufficient for mounting purposes, the embodiment illustrated on FIG. 2 shows an additional mounting member **21*a* similarly containing openings 23 and a pad 25**. In general, modifications of the mounting arrangements can be made to fit various mounting applications.

In conventional fashion, a motor and gear box 27 are supported on one of the portions 21, the motor being provided with a pulley 29. As seen more clearly from FIGS. 2 and 3, the rotating roll 15 has a shaft 31 extending from each side thereof which passes through the opening 17 in the side walls 11 and is supported in the bearing blocks 13. Typically, these will contain ball bearings or roller bearings. On one side, the righthand side in the case of the embodiment of FIG. 3, the shaft extends through the bearing block 13 and has on the end thereof a pulley 33 which is coupled to the pulley 29 by means of a belt 35.

The apparatus is supported above a carpet, or other continuous web 36, moving horizontally therebelow. Typically, the web 36 will have a width of 15 feet, although it will be recognized that other widths are possible.

Figure 4:
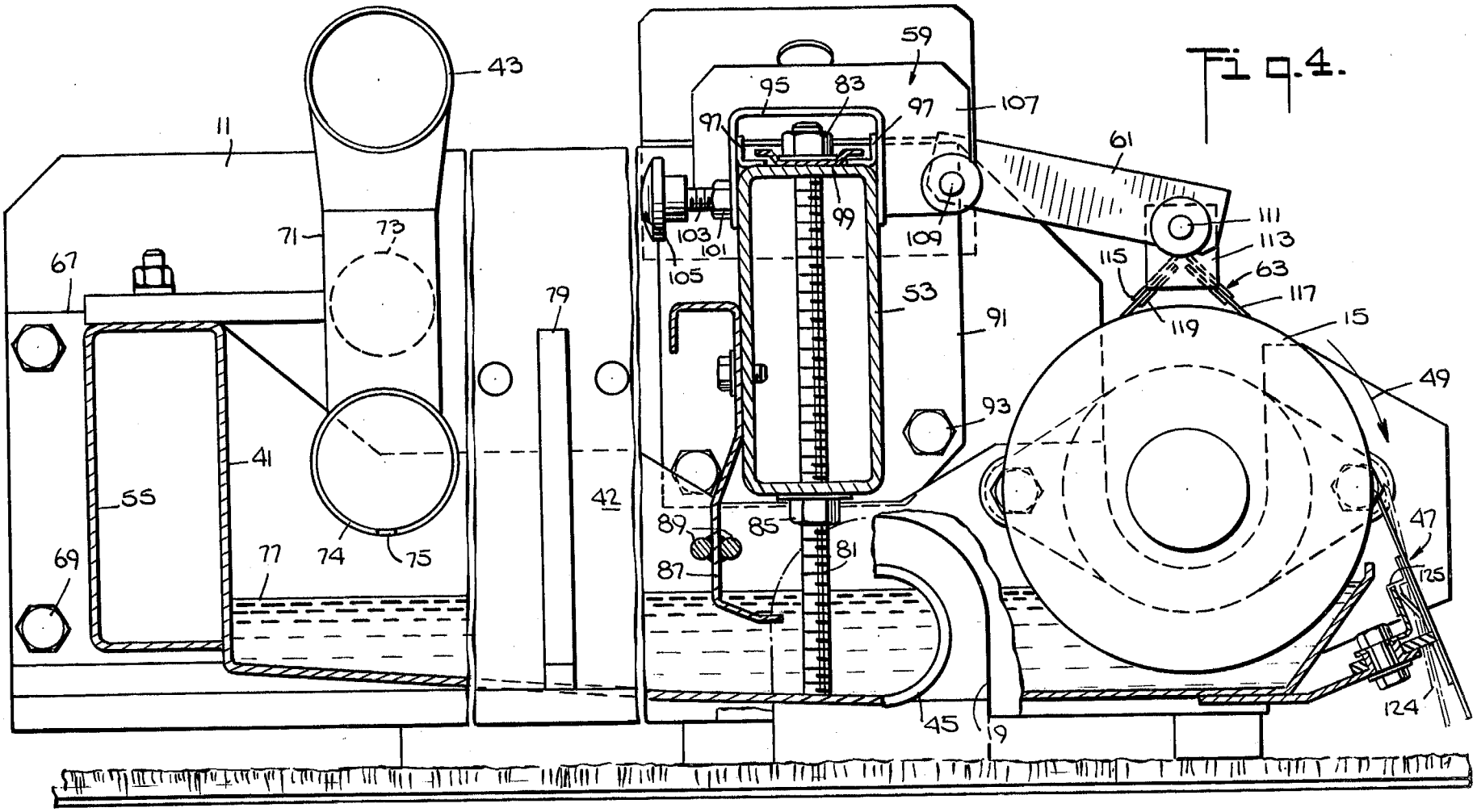
FIG. 4 is a partial cross-sectional view through the apparatus of FIG. 1.

As can most clearly be seen from FIGS. 2 and 3, between the two sides 11 there is disposed a pan 41. In order to maintain suitable support the pan 41 must be made of at least 16 guage stainless steel. The pan 41 extends to a position in front of the roll 15 with the upper edge of its sidewalls 42 passing beneath a cross beam 53 (FIG. 4). In the illustrated embodiment, side walls 42 are spaced from sides 11. However the pan could be designed to fill the space therebetween. A pipe 43 is provided for filling the pan 41 with an application liquid such as a dye. The drain pipe 45 shown on FIG. 1 is used for draining the pan should it be required to change liquids. The rotating roll 15 comes into contact with the liquid in the pan and picks it up. A doctor blade 47 is disposed at the forward edge of the rotating roll 15, which rotates in the direction of the arrows 49, and scrapes off the liquid which has been picked up. This liquid flows down the doctor blade 47 as a film and falls off of the doctor blade onto the web 36. Adjustment means 51 are provided for bringing the doctor blade 47 into and out of contact with the rotating roll 15 in a manner to be described more fully below.

The two sides 11 are held together and the pan 41 supported therein in such a manner as to avoid the need for additional vertical support. At the front near the roll 15 cross beam 53 extends between the two sides 11. Sides 11 are bolted thereto. This beam 53, in addition to holding the two sides together, provides vertical support for the pan 41, which as noted above, extends below the beam, in a manner which will be seen more clearly below. Further, its location near roll 15 allows it to take up twisting forces generated by the roll 15 which might otherwise deform the pan. At the rear, the two sides are held together by a pan stiffener 55, also bolted to the two sides. As will be seen more clearly below, the pan stiffener 55 is part of the pan 41 and thus a separate beam at this point is not necessary. Also provided are supports 57 attached to the pan 41 which support the pipe 43.

The beam 53 contains, on each side, support means 59 having rotatable arms 61 attached thereto. On the ends of the arms 61 are disposed salvage doctor blades 63. The salvage doctor blades 63 are adjustable, the means 59 being provided with adjustments screws for this purpose. They thus can be moved back and forth to define the edges of the liquid which will be scraped off by the doctor blade 47. It is evident, that the salvage doctor blades, having their rear edges located before the top of the rotating roll 15 will scrape off liquid therefrom which will then fall back into the pan before coming into contact with the doctor blade 47.

The various parts just discussed can be seen in more detail from the cross-sectional view of FIG. 4. Shown again are the side frames 11. In this view, the pan 41 is shown in more detail in cross-section. As illustrated, the stiffener 55 is an extension of the rear of the pan bent around and suitably welded by a weld 65. Although the pan does not fill the full width between the side plates 11, the pan stiffener does and has welded to it end plates 67 which are suitably bolted, by bolts 69, to the side plates 11. As shown, the pipe 43 supplies a vertical pipe 71, having the cross-section 73 indicated, which in turn supplies another horizontal pipe 74 having openings 75 distributed over the bottom thereof from which liquid reaches the pan and is brought to a level such as the level 77 shown. If desired, a conventional level control 79 may be provided to maintain the proper level within the pan. Shown again is the drain pipe 45 which extends through the opening 19 in the side 11.

A plurality of threaded rods 81 are welded at spacings across the width of the pan 41. These rods extend up through the cross-beam 53 and are secured in place by nuts 83 and 85 at the top and bottom of the cross beam. These rods thus provide vertical support for the bottom of the pan.

Also attached to the cross beam 53 is a wave breaker 87 in the form of a plate having attached thereto stiffening rods 89 on each side. In this view, end-plates 91 which are welded to each end of the cross beam 53 and the bolts 93 holding them to the side 11 are also visible.

As can be seen, at the top of the cross beam 53 the support means 59 for the salvage doctor blades include a U-shaped bracket 95 which fits over the cross beam 53. Two angle brackets 97, one on each side, are welded to the legs of the bracket 95. These slide beneath a member 99 which is secured in place by the nut 83 at the top of the cross beam 53. A nut 101 is welded to one of the legs of the bracket 95 and a threaded rod 103 with a knob 105 on the end thereof screwed into the nut 101. This permits tightening the bracket 95 into place and also permits adjustably sliding it back and forth across the beam in order to adjust the position of the salvage doctor blades 63.

Attached to the bracket 95 are two plates 107 also visible on FIG. 2. At their front edge, the plates contain openings for supporting a pin 109. The pin 109 is also inserted through the arm 61. Thus, the arm 61 is rotatable about the axis of the pin within the two plates 107. At its other end, the arm 61 contains similar holes through which there extends a pin 111. Pin 111 also extends through brackets 113 which support the salvage doctor blade 63. The salvage doctor blades include a doctor blade retainer 115 of inverted V-shape made of suitable sheet metal with the doctor blades themselves being in the form of fiberglass reinforced polyester stips 117. A backing plate 119 is placed behind each polyester strip for strengthening purposes. Thus, the polyester strips 117 are held between the doctor blade retainer 115 and the backing plates 119 and only the short distances extending therefrom are available to flex.

Figure 6:
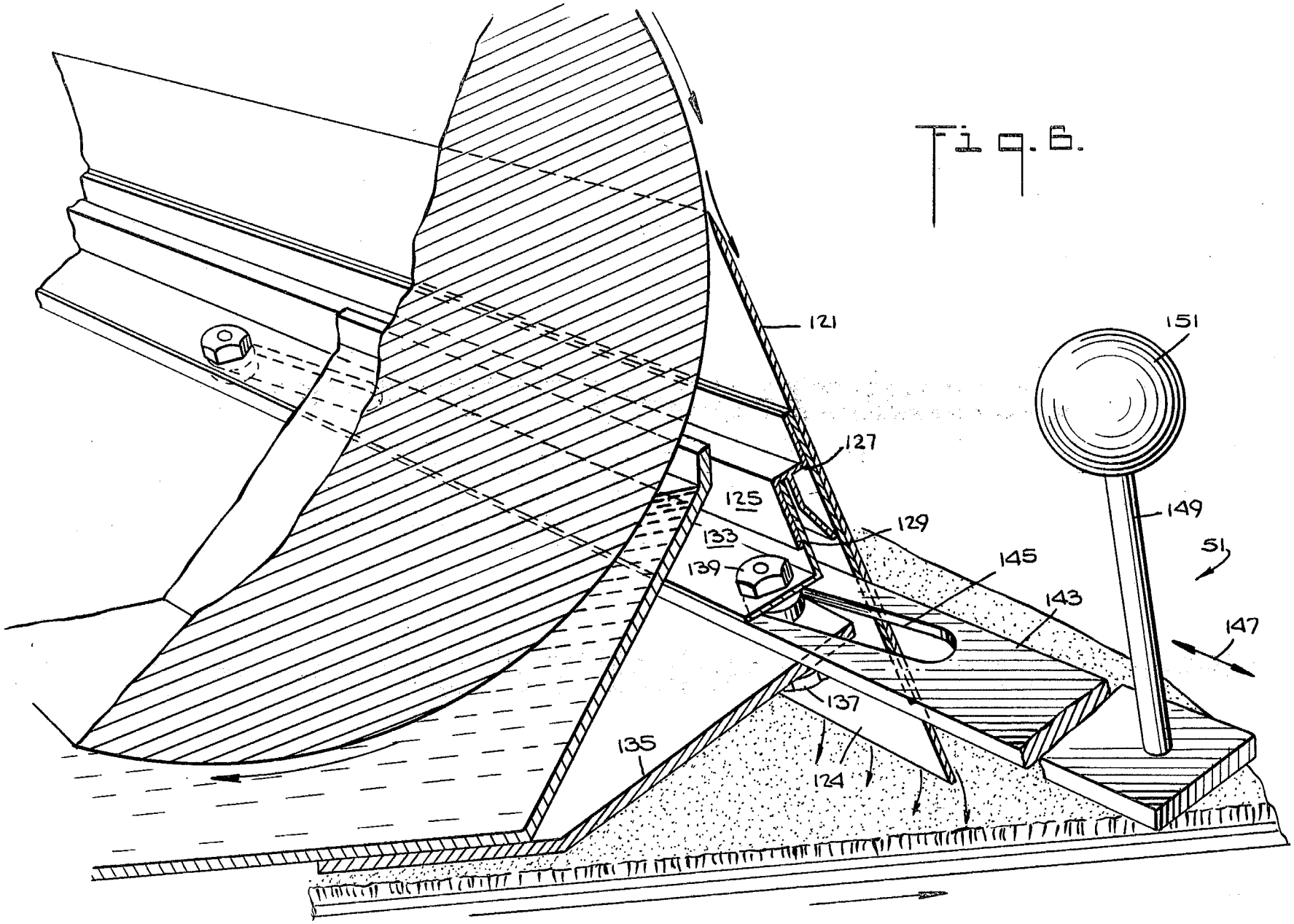
FIG. 6 is a perspective view of the cam bar, roll and doctor blade.

The doctor blade 47 is shown in more detail in FIGS. 4, 6 and 7. In FIG. 4 it is shown in its operating position in solid lines and in its retracted position in dotted lines. The doctor blade 47 includes a portion of sheet metal 121 containing a bevel 123 at its end. At the point where it is supported, it contains a backing piece 124. Attached to the backing piece 124 is an angled member 125 which includes a portion 127 going off at a right angle from the doctor blade and, depending therefrom, a straight portion 129 and a portion 131 with a slight bend (FIGS. 6 and 7). These two portions 129 and 131 form a channel used for supporting the doctor blade. This channel is placed over an angle support 133. The inner portion of the angle support 133 is bolted to an extension 135 which is sutiably attached to the pan 41. The bolting of support 133 to extension 135 is accomplished with a bolt 137 and nut 139 with suitable washers and a spacer 141 therebetween.

The bolt 137 and spacer 141 pass through a cam plate 143. The cam plate contains a plurality of elongated angled slots 145 as may more fully be seen from FIG. 6. Movement of the cam plate 143 back and forth in the direction of the arrow 147 will result in movement of the cam plate between the position shown in solid and the position shown in dotted lines on FIG. 7. When in the position shown in solid lines on FIG. 7, the doctor blade 47, because of its weight, will draw away from the rotating roll 15 and come out of contact with the surface thereof. When the cam plate 143 is moved to the position shown in FIG. 6, it will move to the position shown in dotted lines in FIG. 7 applying pressure against the doctor blade and bringing it into contact with the roll 15. In this manner, simply through a lateral motion, the doctor blade is brought in and out of contact with the roll 15 and problems associated with hinges are avoided.

In order to carry out the doctor blade adjustment, the cam plate 143 extends out beyond one side 11 of the apparatus. At that end it has attached to it a rod 149 with a knob 151 on its end. As shown by FIG. 5, cam plate 143 extends below a right angle bracket 153 which is bolted to the side 11 by bolts 155. A slot 157 for retaining cam plate 143 is made by welding to the bottom of the bracket 153 a piece 159 with rods 161 used as spacers. The horizontal portion of the bracket 153 contains a hole therethrough and disposed above the hole is a nut 163. A shaft 167 containing a knob 169 on its end is threaded into the nut 163. When the knob 151 is grasped and the cam plate 143 moved in or out to either of the positions shown in FIG. 7, it can be held in that position by tightening down on the knob 169 to bring the threaded rod 167 into contact with the cam plate 143. This will then hold it in the desired position.

What is claimed is:

1. In apparatus for applying application liquid to a web of material moving therebelow, the apparatus including a pan, an application roll supported for rotation in said pan and a doctor blade which can be brought into contact with the edge of said roll to scrape liquid therefrom, the doctor blade being directed so that the liquid will flow in a film onto the web of material therebelow, the improvement comprising:

(a) first and second side plates spaced apart;

(b) bearing means in each of said side plates, the roll extending between said side plates and supported in said bearing means;

(c) first support means extending between said side plates directly behind said roll;

(d) the pan being disposed between said side plates and having a portion extending below said roller, the major portion of said pan extending behind said roller;

(e) a plurality of second support means spaced across the width of said pan and attached to the inside of the bottom of said pan, said second support means extending between said bottom and said first support means so that said pan bottom is supported by said first support means;

(f) third support means at the rear end of said pan, attached to said pan and extending between said side plates whereby said apparatus is self supporting and does not require extensive vertical support thereby permitting it to be disposed closely above a horizontal travelling web.

2. The improvement according to claim 1 wherein said third support means comprises a pan stiffener extending between said side plates and further including a plate welded to each end thereof, said plates being bolted to said side plates.

3. The improvement according to claim 1 wherein said first support means comprises a cross beam and further including a plate secured to said cross beam and extending into the liquid in said pan to act as a wave breaker.

4. The improvement according to claim 3 and further including first and second salvage doctor blades contacting said roll near its top, and first and second means for horizontally adjusting said salvage doctor blades.

5. The improvement according to claim 4 wherein each of said first and second means for adjusting comprise a bracket slidably mounted on said cross beam; means to secure said bracket at any point along said cross beam; and an arm rotatably supported to said bracket, said salvage doctor blades being rotatably supported to the ends of said arms.

6. The improvement according to claim 5 wherein said salvage doctor blades each comprise:

(a) a doctor blade support having an inverted V-shape; and (b) first and second blades of fiberglass reinforced polyester secured respectively to the two sides of said inverted V, said blades being in contact with said application roll.

7. The apparatus according to claim 6 and further including backing plates behind said fiberglass reinforced polyester blades.

8. The improvement according to claim 1 and further including means for supplying an application liquid to said pan and means for removing application liquid from said pan.

9. The improvement according to claim 1 wherein said doctor blade comprises:

(a) a rectangular blade member; and (b) a bracket containing a channel therein attached to said blade member, and further including means for supporting and moving said doctor blade comprising:

(c) an angle bracket attached to said pan, said channel placed over said bracket so as to be rotatable thereon;

(d) a laterally movable cam plate capable of abutting against said doctor blade so as to rotate it on said angle bracket and bring it in and out of contact with said roll as said cam plate is moved, and (e) means for supporting said cam plate.

10. The improvement according to claim 9 wherein said means for supporting said cam plate include: a support bracket attached to said pan across the width of said pan and extending in a forward direction therefrom, said support bracket containing a plurality of holes across the width thereof; a plurality of bolts, one extending through each hole; a spacer placed over each bolt; said angle bracket containing a plurality of holes matching those in said support bracket and disposed over said spacers on said bolts; a plurality of nuts holding said angle brackets to said support bracket and wherein said cam plate comprises a plate containing a plurality of angled slots, one for each of said bolts, said cam plate being mounted over said forwardly extending support bracket with said spacers in the slots thereof, slidable on said spacers, and further including means for moving said cam plate transversely whereby said transverse motion due to said angled slots will result in a motion to move said doctor blade in and out of contact with said application roll.

11. The improvement according to claim 10 and further including means for securing said cam plate in either a position where said doctor blade is in contact with said application roll or out of contact therewith.

12. The improvement according to claim 11 wherein said cam bar extends out beyond one of said sides of said apparatus and further including a right angle bracket secured to one of said sides, said right angle bracket having means forming a slot at the bottom thereof through which said cam bar passes, said means for moving comprising a rod attached to the end of said cam bar and said means for securing comprising:

(a) a hole in the horizontal portion of said right angle bracket;

(b) a nut aligned with and welded over said hole; and (c) a threaded rod with a knob on the end thereof threaded into said nut whereby tightening of said rod against said cam bar will result in securing said cam bar in the desired position.

13. The improvement according to claim 1 and further including horizontal portions extending from each of said side plates, said horizontal portions containing mounting openings therein for mounting said apparatus to a supporting base.

14. The improvement according to claim 1 wherein said third support means comprise a pan stiffener which is an integral portion of said pan.

* * * * *